US008326195B2

(12) United States Patent
Aimoto et al.

(10) Patent No.: US 8,326,195 B2
(45) Date of Patent: Dec. 4, 2012

(54) TRANSFER DEVICE AND IMAGE FORMING APPARATUS

(75) Inventors: Toyoka Aimoto, Osaka (JP); Toshimasa Hamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 316 days.

(21) Appl. No.: 12/788,710

(22) Filed: May 27, 2010

(65) Prior Publication Data

US 2010/0303518 A1 Dec. 2, 2010

(30) Foreign Application Priority Data

Jun. 2, 2009 (JP) ..... P2009-133484

(51) Int. Cl.
*G03G 15/20* (2006.01)

(52) U.S. Cl. ..... 399/314; 399/66

(58) Field of Classification Search ..... 399/66, 399/314

See application file for complete search history.

(56) References Cited

U.S. PATENT DOCUMENTS 6,163,663 A 12/2000 Shinohara et al.
6,766,125 B1 * 7/2004 Izumi ..... 399/66
7,890,029 B2 * 2/2011 Hamada ..... 399/270
2008/0152373 A1 * 6/2008 Ahn et al. ..... 399/66

FOREIGN PATENT DOCUMENTS

JP 08-334954 12/1996
JP 09-146381 6/1997
JP 2006-227525 8/2006

* cited by examiner

*Primary Examiner* — Walter L Lindsay, Jr.
*Assistant Examiner* — Benjamin Schmitt
(74) *Attorney, Agent, or Firm* — Nixon & Vanderhye, P.C.

(57) ABSTRACT

A transfer device and an image forming apparatus capable of forming an image of smooth image quality with little uneven density, are provided. An alternating voltage is applied so that a first period in which a first peak-to-peak voltage Vpp(1) is applied and a second period in which a second peak-to-peak voltage Vpp(2), lower than the first peak-to-peak voltage, is applied are alternately repeated. In the alternating voltage to be applied, a transfer side potential to shift a toner from an intermediate transfer belt to recording paper sheet and an opposite transfer side potential to shift the toner from the recording paper sheet to the intermediate transfer belt are applied so as to alternate with each other. When f1 denotes a frequency of the first period and f2 denotes a frequency of the second period, f1=f2 is satisfied.

10 Claims, 8 Drawing Sheets

TRANSFER DEVICE AND IMAGE FORMING APPARATUS

CROSS-REFERENCE TO RELATED APPLICATION

This application claims priority to Japanese Patent Application No. 2009-133484, which was filed on Jun. 2, 2009, the contents of which are incorporated herein by reference in its entirety.

BACKGROUND OF THE INVENTION

1. Field of the Invention

The technology disclosed herein relates to a transfer device and an image forming apparatus that transfer a toner image formed on an intermediate transfer member onto a recording paper sheet by applying an alternating voltage superimposed on a direct current voltage.

2. Description of the Related Art

In an electrophotographic image forming apparatus, a development method has been employed in which a surface of an electrostatic latent image bearing member (for example, a photoreceptor) is charged and an image is exposed to the charged region to from an electrostatic latent image, and the electrostatic latent image is developed so as to be made visible (developing).

As such a development method, a development method has been commonly used in which, using one-component developer containing a toner or two-component developer containing a carrier and a toner, by frictionally charging the toner so that the toner is attracted with an electrostatic force of an electrostatic latent image on the surface of the electrostatic latent image bearing member, the electrostatic latent image is developed to thereby form a toner image.

A toner image formed on the electrostatic latent image bearing member is transferred again onto an intermediate transfer member, which is a drum-shape or a belt-shape, with an electrostatic force. The toner image transferred onto the intermediate transfer member is to be further transferred onto the recording paper sheet with the electrostatic force.

Finally, the recording paper sheet is conveyed to a fixing device to fix the transferred toner image on a surface of the paper by applying heat and pressure, and thus paper on which an image is printed is obtained.

In such an image forming apparatus, it is desired to form an image of smooth image quality with little roughness.

Furthermore, it is desired to obtain the similar image quality not only under the normal temperature but also even with conditions of high temperature and high humidity, or conditions of low temperature and low humidity, and it is desired to obtain the similar image quality for not only the plain paper but also for various types of recording paper sheet such as heavy paper or unlevel embossed paper.

However, for example, when a two-component developer is used, a charge amount held by a toner is easily changed depending on the surrounding environment or the using situation and thus is unstable as transferring performance using the electrostatic force, therefore, it is difficult to transfer the toner image on the intermediate transfer member onto the recording paper sheet at a rate of 100%.

Therefore, various approaches have been taken conventionally for the improvement of such a transfer property. For example, a method that one in which direct current bias and alternating current bias are superimposed is applied as a secondary transfer bias to a primary transfer image which has been transferred onto the intermediate transfer member, to be transferred onto the recording paper sheet, has been proposed (for example, refer to Japanese Unexamined Patent Publication JP-A 9-146381 (1997)).

In the image forming apparatus described in JP-A 9-146381, although it is described as excellent in a cleaning property of the intermediate transfer member and in transfer efficiency from the intermediate transfer member to the recording paper sheet, and especially there will be no occurrence of local transfer failure, it is not possible to form a sufficiently high quality image since as a bias waveform to be used, a constant alternating current component is merely superimposed on a direct current component.

SUMMARY OF THE INVENTION

An object of the technology disclosed herein is to provide a transfer device and an image forming apparatus capable of forming an image of smooth image quality with little uneven density.

The technology disclosed herein technology disclosed herein provides a transfer device comprising:

a toner image bearing member that bears a toner image thereon;

a transfer section that transfers the toner image borne on the toner image bearing member onto a recording medium; and a bias applying section that applies a transfer bias voltage for transferring the toner image, the bias applying section applying a transfer bias voltage which an alternating voltage is superimposed on a direct current voltage, the alternating voltage having an alternating voltage waveform in which a transfer side potential to shift the toner image from the toner image bearing member to the recording medium and an opposite transfer side potential to shift the toner image from the recording medium to the toner image bearing member are applied so as to alternate with each other, and a first period in which a first peak-to-peak voltage is applied and a second period in which a second peak-to-peak voltage, lower than the first peak-to-peak voltage, is applied, are alternately repeated, and when f1 denotes a frequency of the first period and f2 denotes a frequency of the second period, f1=f2 is satisfied.

According to the technology disclosed herein, the bias applying section applies a transfer bias voltage which an alternating voltage is superimposed on a direct current voltage, and the alternating voltage has an alternating voltage waveform in which a transfer side potential to shift the toner image from the toner imager carrier to the recording medium and an opposite transfer side potential to shift the toner image from the recording medium to the toner image bearing member are applied so as to alternate with each other. Furthermore, in the alternating voltage, a first period in which a first peak-to-peak voltage is applied and a second period in which a second peak-to-peak voltage, lower than the first peak-to-peak voltage, is applied, are alternately repeated, and when f1 denotes a frequency of the first period, and f2 denotes a frequency of the second period, f1=f2 is satisfied.

By applying the first peak-to-peak voltage which is relatively large, an image density is enhanced, and by applying the second peak-to-peak voltage which is relatively small, it is possible to reduce the uneven density and form an image of a smooth image quality while maintaining the image density. Moreover, by making f1=f2, a circuit configuration of the bias applying section is able to be simplified.

Further in the technology disclosed herein, it is preferable that a potential applied at an end of the first period is the transfer side potential in the alternating voltage.

According to the technology disclosed herein, a potential applied at an end of the first period is the transfer side potential, so that the uneven density is able to be reduced.

Further, in the technology disclosed herein, it is preferable that a periodic number included in the first period is two or three in the alternating voltage.

According to the technology disclosed herein, a periodic number included in the first period is two or three, so that both enhancement of the image density and the reducing of the uneven density are able to be achieved.

Further, in the technology disclosed herein, it is preferable that a periodic number included in the second period is two or three in the alternating voltage.

According to the technology disclosed herein, a periodic number included in the second period is two or three, so that both the enhancement of the image density and the reducing of the uneven density are able to be achieved.

Further, in the technology disclosed herein, it is preferable that the following expression is satisfied in the alternating voltage:

$$2 \leqq Vpp(1)/Vpp(2) \leqq 17.8,$$

where Vpp(1) denotes a peak-to-peak voltage in the first period and Vpp(2) denotes a peak-to-peak voltage in the second period.

According to the technology disclosed herein, when Vpp (1) denotes a peak-to-peak voltage in the first period, and Vpp(2) denotes a peak-to-peak voltage in the second period, $2<Vpp(1)/Vpp(2)<17.8$ is satisfied, so that both the enhancement of the image density and the reducing of the uneven density are able to be achieved.

Further, in the technology disclosed herein, it is preferable that the frequency f1 in the first period is 10 kHz or less in the alternating voltage.

According to the technology disclosed herein, the frequency f1 in the first period is 10 kHz or less, so that a minute toner adhesion called scattering is able to be suppressed.

Further, in the technology disclosed herein, it is preferable that the peak-to-peak voltage in the first period Vpp(1) satisfies the following expression in the alternating voltage:

$$Vpp(1) \leqq 5 \text{ kV}.$$

According to the technology disclosed herein, the peak-to-peak voltage Vpp (1) in the first period is Vpp (1)≦5 kV, so that the opposite transfer is suppressed and an image density is able to be enhanced.

Further, in the technology disclosed herein, it is preferable that the bias applying section applies the transfer bias voltage to the transfer section.

Further, in the technology disclosed herein, it is preferable that the bias applying section applies the transfer bias voltage to the toner image bearing member.

According to the technology disclosed herein, the bias applying section applies the transfer bias voltage to the transfer section, or to the toner image bearing member, so that the image uneven density is able to be reduced while maintaining the image density with a simple configuration.

Further, the technology disclosed herein provides an image forming apparatus comprising:

an electrostatic latent image bearing member that bears an electrostatic latent image thereon;

a developing device that develops the electrostatic latent image to form a toner image for transferring to a toner image bearing member; and the transfer device mentioned above.

According to the technology disclosed herein, an electrostatic latent image formed on the electrostatic latent image bearing member is developed by a developing device, and a developed toner image is transferred to a toner image bearing member to be borne thereon. The bias applying section applies the transfer bias voltage, so that the transfer section transfers the toner image from the toner image bearing member to the recording medium.

Thereby, the uneven density is able to be reduced and an image of a smooth image quality is able to be formed while maintaining the image density.

BRIEF DESCRIPTION OF DRAWINGS

Other and further objects, features, and advantages of the technology described herein will be more explicit from the following detailed description taken with reference to the drawings wherein.

DETAILED DESCRIPTION

Figure 1:
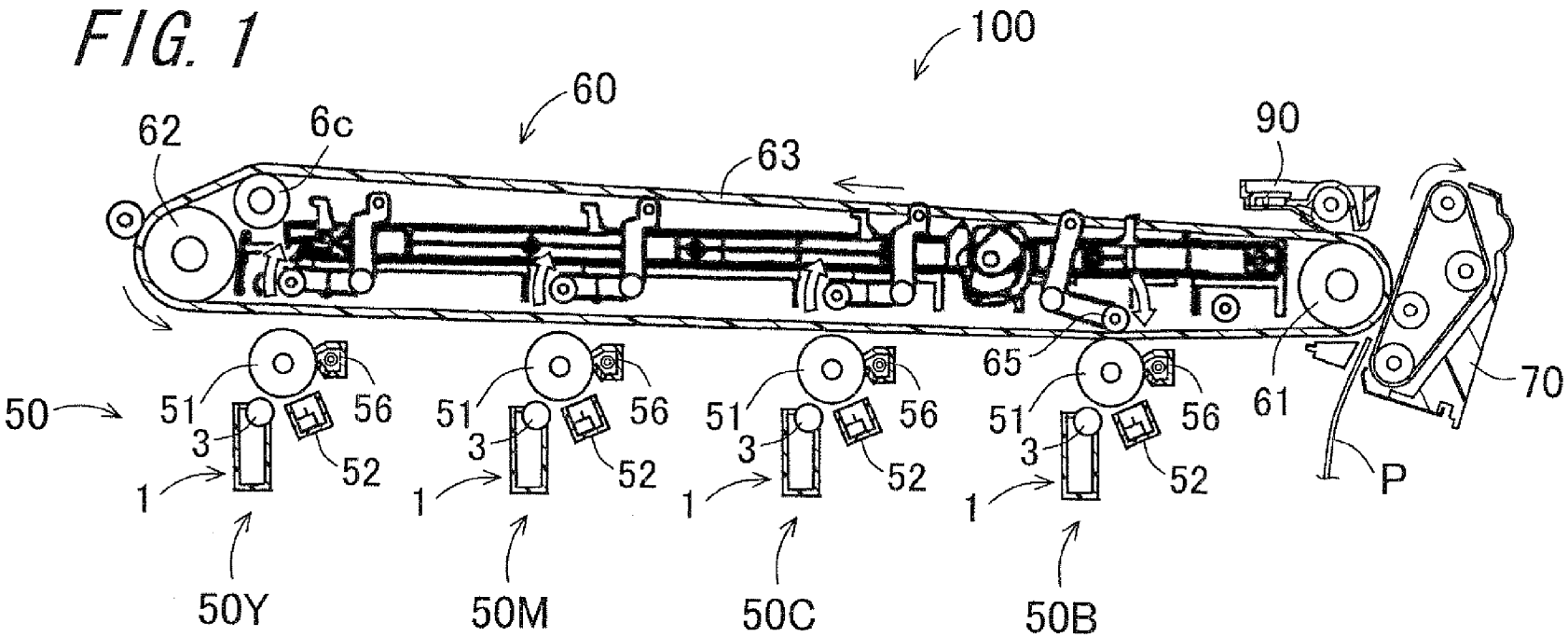
FIG. 1 is a vertical cross sectional view schematically showing an overview of an entire configuration of an image forming apparatus according to a first embodiment.

Now referring to the accompanying drawings, embodiments of the technology described herein are described in detail below. Note that, in this specification and drawings, the components having substantially the same functions are denoted by the same reference numerals so that repeated description will be omitted.

First, a configuration of a first embodiment of an image forming apparatus according to the invention will be described with reference to the drawing. FIG. 1 is a vertical cross sectional view schematically showing an overview of an entire configuration of an image forming apparatus 100 according to the first embodiment. Note that, for simplicity, FIG. 1 only shows an example of the image forming apparatus 100 of this embodiment mainly with principal components, which is not limited to a configuration of an image forming apparatus that comprises a transfer device according to the technology described herein.

The image forming apparatus 100 is a tandem type color image forming apparatus capable of forming a color image, which includes a plurality of photoreceptors 51 serving as an electrostatic latent image bearing member, and includes four photoreceptors for yellow images, magenta images, cyan images, and black images in this embodiment. The image forming apparatus 100 has a printer function of forming a color image or a monochrome image on a sheet P serving as a transfer receiving member (recording medium) based on image data transmitted from various kinds of information processing terminal apparatus such as a PC (Personal Computer) connected through a network or image data read by a document reading apparatus such as a scanner.

The image forming apparatus 100 includes, as shown in FIG. 1, an image forming station section 50 (50Y, 50M, 50C, 50B) that has a function of forming an image on the sheet P, a primary transfer member section 60 that transfers a toner image formed by the image forming station section 50, a secondary transfer member section 70 that transfers the toner image formed in the primary transfer member section 60 to the surface of the sheet P, a fixing device 40 that has a function of fixing the toner image formed on the surface of the sheet P, and the like.

The image forming station section 50 is configured with four image forming stations 50Y, 50M, 50C, and 50B for yellow images, magenta images, cyan images, and black images, respectively.

Specifically, along the primary transfer member section 60, toward the secondary transfer member section 70, the yellow image forming station SOY, the magenta image forming station 50M, the cyan image forming station 50C, and the black image forming station 50B are arranged side by side in a line in this order.

The image forming stations 50Y, 50M, 50C, and 50B for the respective colors have substantially the same structure, and form yellow, magenta, cyan, and black images according to image data corresponding to the respective colors so that the images are eventually transferred onto the sheet P serving as the transfer receiving member (recording medium).

The image forming station section 50 of this embodiment has a configuration to form images in four colors of yellow, magenta, cyan, and black, but may have a configuration to form images in six colors additionally including, for example, light cyan (LC) and light magenta (LM) that have the same color hues as cyan and magenta and have a lower density, without limitation to the four colors.

The image forming stations 50Y, 50M, 50C, and 50B respectively includes the photoreceptor 51 serving as a latent image bearing member on which an electrostatic latent image is formed, and a charging device 52, a developing device 1, and a cleaning device 56 are disposed in the circumferential direction around the photoreceptor 51.

The photoreceptor 51 is in the shape of a substantially cylindrical drum on the surface of which a photosensitive material such as an OPC (Organic Photoconductor) is provided, and is controlled so as to be rotationally driven in a predetermined direction by a driving section and a control section.

The charging device 52 is a charging section for uniformly charging the surface of the photoreceptor 51 to a predetermined potential, and is disposed close to an outer circumferential surface of the photoreceptor 51. In the embodiment, although a non-contact charger type charging device is used, a charging device of an ion emission-charging type, or a contact-type charging device of a roller type, a brush type or the like may be usable.

An exposure device has a function of exposing the photoreceptor 51 whose surface is charged with the charging device 52 by irradiating with laser light based on image data outputted from an image processing section to thereby write and form an electrostatic latent image according to the image data on the surface of the photoreceptor. The exposure device forms an electrostatic latent image in accordance with a corresponding color when image data that corresponds to yellow, magenta, cyan, or black is inputted respectively according to each of the image forming stations 50Y, 50M, 50C, or 50B. As the exposure device, a laser scanning unit (LSU) including a laser irradiation section and a reflection mirror or a writing device (for example, a writing head) in which light emitting elements such as ELs and LEDs are arranged in an array is usable.

The developing device 1 has a developing roller 3 serving as a developer bearing member that bears developer thereon. The developing roller 3 is configured so that developer is conveyed to a development region in which a toner can move to the photoreceptor 51. In this embodiment, the developing device 1 uses two-component developer including a toner and a carrier, and forms a toner image (visible image) by performing reversal development with the toner of an electrostatic latent image that has been formed on the surface of the photoreceptor 51 by the exposure device.

The developing device 1 contains yellow, magenta, cyan, or black developer according to the respective image forming stations 50Y, 50M, 50C, and 50B. The developer includes a toner that is charged with a polarity the same as the surface potential that is charged to the photoreceptor 51. Note that, the polarity of the surface potential that is charged to the photoreceptor 51 and the charged polarity of the toner used are both negative (negative polarity) in this embodiment.

The primary transfer member section 60 is a toner image bearing member that transfers a toner image formed on the photoreceptor 51 onto an intermediate transfer belt 63 and bears the transferred toner image on the intermediate transfer belt 63, and has a transfer roller 65 to which a bias voltage that has a polarity (positive (positive polarity) in the embodiment) opposite to the charged polarity of the toner is applied.

The cleaning device 56 is to remove and collect a toner remaining on the outer circumferential surface of the photoreceptor 51 after transferring the toner image to the intermediate transfer belt 63.

The primary transfer member section 60 includes a driving roller 61, a driven roller 62, and the intermediate transfer belt 63, and a toner image in each color is transferred by each of the image forming stations 50Y, 50M, 50C, and 50B. The intermediate transfer belt 63 is configured so as to be supported around the driving roller 61 and the driven roller 62 with tension, and the surface to which the toner image is transferred is arranged so as to face each of the image forming stations 50Y, 50M, 50C, and 50B.

At the position facing each of the image forming stations 50Y, 50M, 50C, and 50B, toner images formed on the respective photoreceptors 51 are transferred onto the intermediate transfer belt 63 with the action of a transfer electric field by the transfer roller 65 that is arranged with the intermediate transfer belt 63 interposed therebetween. After that, the toner images of the respective colors are subjected to the secondary transfer so that the toner images of the respective colors are overlaid on the sheet P in the secondary transfer member section 70, and a full-color toner image is formed on the sheet P. The sheet P to which the toner image is transferred in this manner is subjected to a heat fixing of the toner image by the fixing device 40, and is discharged to a discharge tray.

The fixing device 40 includes a heat roller 41 and a pressure roller 42, and by conveying the sheet P to a nip region formed therebetween, applies heat and pressure to the toner image transferred to the sheet P to fix the same on the sheet P.

Figure 2:
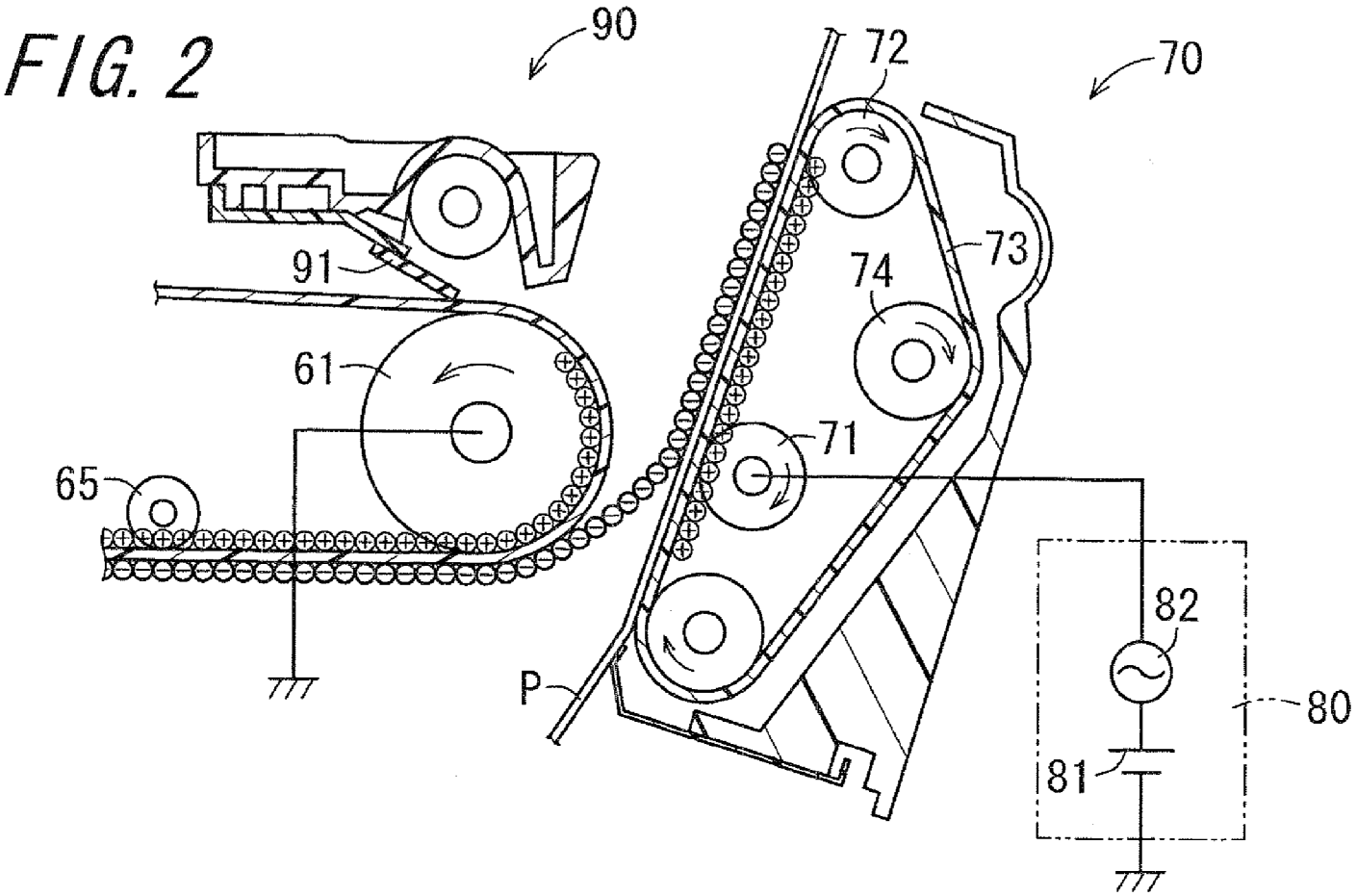
FIG. 2 is an enlarged view of a secondary transfer member section.

FIG. 2 is an enlarged view of the secondary transfer member section 70. The transfer roller 65 is arranged at a position facing the photoreceptor 51 with the intermediate transfer belt 63 interposed therebetween as described above, and rotatably supported by a conductive bearing. The conductive bearing is connected to a compression spring and the transfer roller 65 is added a force from the compression spring through the conductive bearing so as to be in pressure-contact with the photoreceptor 51. The transfer roller 65 is configured by a core metal comprised of a bar material of stainless steel or iron, and a conductive foamed elastic layer which is formed on the outer circumference of the core metal. The foamed elastic layer is comprised of a polyurethane rubber or EPDM (ethylene-propylene-diene copolymer rubber). Furthermore, a volume resistance value of the foamed elastic layer is about $10^7$ Ω·cm, and a hardness is set to be 45 to 60 degrees in JIS-C (ASKER C).

In addition, the transfer roller 65 is connected to a high voltage power source through the compression spring and the conductive bearing. Thereby, in transferring, a transfer bias which has a polarity opposite to that of the developer is applied to the transfer roller 65 from the high voltage power source. In the embodiment, since the toner as the developer is negatively charged, in applying the transfer bias, positive transfer bias is imparted to the transfer roller 65.

On a downstream side of the conveyance direction of the intermediate transfer belt 63 from the transfer roller 65, the driving roller 61 is arranged. The driving roller 61 is drivingly rotated by a rotary drive section counterclockwise when facing to the paper surface. Furthermore, the driving roller 61 is configured, similarly to the transfer roller 65, by a core metal comprised of a bar material of stainless steel or iron, and a conductive foamed elastic layer which is formed on the outer circumference of the core metal. Additionally, the core metal of the driving roller 61 is grounded.

The intermediate transfer belt 63 is formed to be an endless-shape by a centrifugal molding, or the like, out of polyimide as a chief material. In addition, the intermediate transfer belt 63 has the conductivity and the thickness is about 60 μm to 140 μm. Note that, a volume resistance value of the intermediate transfer belt 63 is $10^8$ to $10^{12}$ Ω·cm.

The secondary transfer member section 70 is a transfer section including a secondary transfer roller 71, a driving roller 72, a secondary transfer belt 73, and a tension roller 74. The secondary transfer roller 71 is arranged at a position facing the driving roller 61 with the secondary transfer belt 73 interposed therebetween, and is rotatably supported by a conductive bearing. Note that, the configuration and the material quality of each roller and the belt are same as those of the primary transfer member section 60.

The secondary transfer roller 71 is connected to a transfer bias applying section 80 through a compression spring and the conductive bearing. Thereby, in transferring, a secondary transfer bias which has a polarity opposite to that of the developer is applied to the secondary transfer roller 71 from the transfer bias applying section 80. In the embodiment, since the toner as the developer is negatively charged, in applying the secondary transfer bias, positive secondary transfer bias is imparted to the secondary transfer roller 71. In the embodiment, the transfer bias applying section 80 is provided with a direct current power source 81 and an alternating current power source 82 connected in series, and the alternating current component is superimposed on the direct current component as the secondary transfer bias.

Note that, although it is illustrated in FIG. 2 that a space is provided between the primary transfer member section 60 and the secondary transfer member section 70, this is the view for making easier to understand the configuration of each transfer section and the secondary transfer from the primary transfer member section 60 to the sheet P, and in fact, the primary transfer member section 60 and the secondary transfer member section 70 are in contact with each other to form a transfer nip region. The sheet P passes through the transfer nip region formed between the primary transfer member section 60 and the secondary transfer member section 70, so that a toner image on the intermediate transfer belt 63 is transferred onto the sheet P.

By using the secondary transfer belt 73, a transfer nip width is allowed to be wider so that releasability of the paper from the transfer member section is improved.

On the other hand, since the transfer efficiency of the toner image from the intermediate transfer belt 63 to the sheet P does not become 100% with various factors, an amount of a small percentage of the toner remains on the intermediate transfer belt 63. The residual toner is removed by a cleaning device 90 which is provided downstream from a position of the secondary transfer. In the embodiment, although the residual toner is removed with using a blade member 91, a brush member or the like is also usable.

As the toner included in the developer to be used in the technology described herein, a toner whose shape factor SF-1 is in a range of 100 to 160 and a toner whose shape factor SF-2 is in a range of 100 to 150 are usable, and more preferably, the SF-1 is 110 to 150 and the SF-2 is 110 to 140.

The toner shape factor SF-1 represents a degree of a roundness of toner particles and the shape factor SF-2 represents a degree of unevenness of the surface of toner particles. The shape factor is a value obtained by randomly sampling 100 toner images magnified 500 times that have been shot with the use of, for example, FE-SEM (S-800) manufactured by Hitachi, Ltd. and analyzing image information thereof with an image analysis apparatus (Luzex III) manufactured by Nireco Corporation, for example.

In the case of SF-1<110, a toner has a shape similar to a spherical shape, and therefore, there is a case where the toner slips on an endless conveyance belt to cause distortion of a transfer image when the toner is transferred from the photoreceptor to the endless conveyance belt. In the case of SF-1>150, a toner is greatly deformed and a projected portion on the toner surface is separated from the toner surface by stirring to be fine powders which cause toner dispersion or adhere to the carrier surface or the development sleeve surface, resulting in inhibition of sufficient friction charge with the toner in some cases.

Further, in the case of SF-2<110, the toner surface has high smoothness, and there is a case where the toner slips on the endless conveyance belt to cause distortion of the transfer image similarly to the case of SF-1<110. In the case of SF-2>140, toner surface has large unevenness, and there is a case where a variation is generated in a charge amount of individual toner and the image density is not stabilized to cause fog.

Further, a toner weight in an image area having 100% image area rate of a transfer image falls within a range of 0.20 to 0.50 mg/cm$^2$, and in the case of a transfer image of processed black (a state of black formed by overlaying three colors of yellow, cyan, and magenta), the toner weight in the image area having 100% image area rate of the transfer image is preferably adjusted within a range of 0.60 to 1.5 mg/cm$^2$.

In the case of the toner weight <0.20 mg, it is impossible to cover a paper face fully with a toner, and therefore, uniform and sufficient image density is unable to be obtained. In the case of the toner weight >0.50 mg, a toner layer is thickened particularly in the case of overlapping three colors and temperature margin at a fixing step is made severe greatly.

The toner to be used in the technology described herein is able to be prepared by a known manufacturing method, and examples thereof include a pulverizing method, a suspension polymerization method, an emulsion polymerization method, a solution polymerization method, and an ester elongation polymerization method. As a carrier, a ferrite resin coated carrier having a volume average particle size of 40 μm was used. Without limitation to the ferrite resin coated carrier in particular, a ferrite non-resin-coated carrier, an iron powder type and a binder type carrier are also usable.

As a result of measuring an electric charge of a mirror image remaining on carrier by a commercially available coulombmeter when about 200 mg of two-component developer was put on a metal mesh (of 500 mesh) in an electrically shielded case and a toner was sucked by air through the metal mesh, a charge amount of the toner was about −30 μC/g.

Next, a transfer operation executed by the secondary transfer member section 70 of the image forming apparatus 100 will be described with reference to the drawings.

Figure 3A:
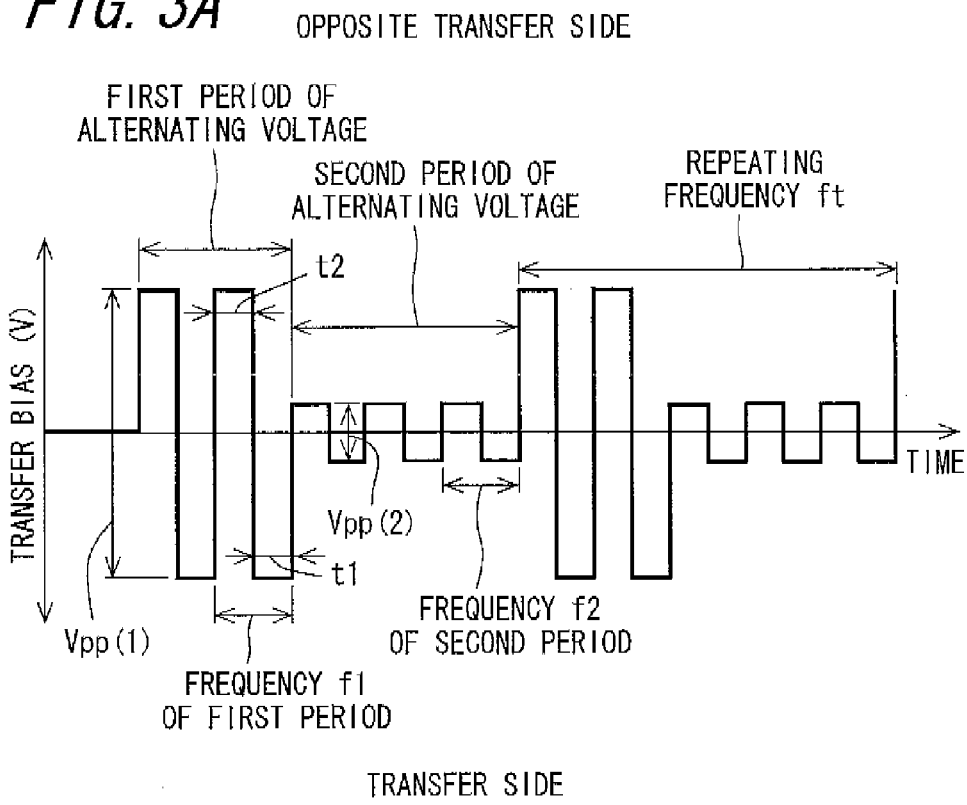
FIG. 3A is a view showing a transfer bias voltage waveform of the technology described herein.

The transfer bias applying section 80 applies a transfer bias voltage that has a waveform as shown in FIG. 3A to the secondary transfer roller 71 of the secondary transfer member section 70, which is an oscillating bias voltage as an alternating voltage in which a transfer side potential that applies a force to the toner image to move from the intermediate transfer belt 63 to the sheet P and an opposite transfer side potential that applies a force to the toner image to move from the sheet P to the intermediate transfer belt 63 alternate with each other periodically.

As shown in the waveform of FIG. 3A, in the embodiment, a bias voltage waveform is repeatedly applied in which following a first period where a peak-to-peak voltage (hereinafter, referred to as a Vpp) of a transfer bias voltage is large, a second period where a Vpp is small is provided. In addition, a frequency f1 of the first period and a frequency f2 of the second period satisfy f1=f2, and when t1 denotes a time during which a transfer side potential to shift the toner from the intermediate transfer belt 63 to the sheet P is applied, and t2 denotes a time during which an opposite transfer side potential to shift the toner from the sheet P to the intermediate transfer belt 63 is applied, t1=t2 is satisfied.

By providing the first period during which Vpp(1) which is a large Vpp is applied, a large electric field acts on the toner in the first period so that the toner is easily separated from the intermediate transfer belt 63, and the toner flies from the intermediate transfer belt 63 to the sheet P.

Further, as shown in FIG. 3A, the potential finally applied in the first period (final potential) is preferably the transfer side potential. As will be described in detail below, in the case of the transfer bias waveform as shown in FIG. 4, that is, in the case where the potential finally applied in the first period is the opposite transfer side potential, the uneven density becomes significant.

It is important that the first period during which a large Vpp is applied is completed in a state of the transfer side potential being finally applied and is shifted to the second period in a state where toner is moving to the sheet P to reduce a Vpp. Thereby, the toner is easily transferred to the sheet P and the opposite transfer is hard to occur at the same time.

Figure 4:
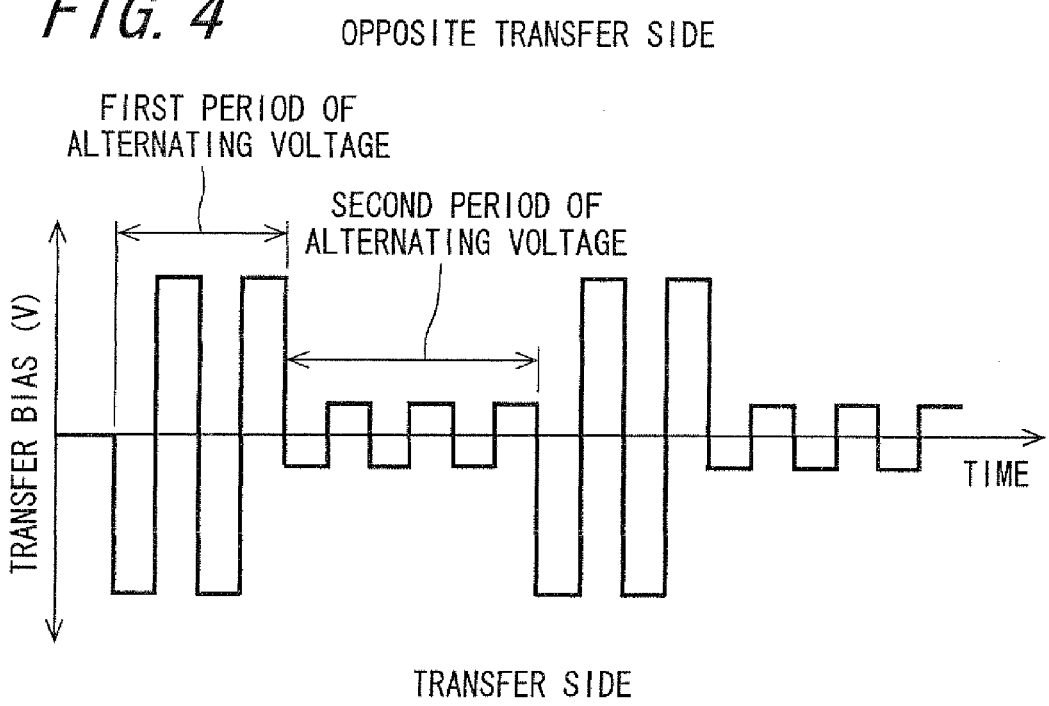
FIG. 4 is a view showing a transfer bias voltage waveform in a case where a final potential is an opposite transfer side potential.

To the contrary, as shown in FIG. 4, when the first period is completed in a state of the opposite transfer side potential being finally applied, it is shifted to the second period in a state where an electric field is applied in a direction where the toner returns to the intermediate transfer belt 63 and a Vpp is reduced, thus, the toner is hard to move to the sheet P and the image density is lowered.

To study the first embodiment more specifically, experiments were conducted as follows.

Note that, unless otherwise mentioned, the following experiment data were obtained by using a multifunctional peripheral MX-7001N manufactured by Sharp Corporation as an image forming apparatus. However, various transfer bias waveforms were outputted by using an arbitrary waveform generator (trade name: HIOKI 7075, manufactured by HIOKI E. E. CORPORATION) and an amplifier (trade name: HVA4321, manufactured by NF Corporation). The toner used for the experiments has the volume average particle size of 7 μm, which was measured by Coulter Counter Model TA-II.

Further, the image density was obtained by measuring a solid image density by a portable spectrodensitometer (trade name: X-Rite 939, manufactured by X-Rite Incorporated).

First, as Study Example 1, only a direct current component was applied to the transfer bias. At this time, a direct current voltage DCV was 1 kV. A current value was I=9 μA. Further, DCV was increased to 1.7 kV as Study Example 2, and DCV was increased to 2.5 kV as Study Example 3, although there was an increase in the image density in Study Example 2, from the voltage value thereabove, an opposite transfer phenomenon started to occur, and in Study Example 3, lowering of the image density occurred. Note that, the uneven density (roughness of image) was not improved even though the direct current voltage was increased. That is, it was found that an image quality was not able to be improved by merely applying a direct current component to increase the direct current voltage. The evaluation results described above are shown in Table 1.

TABLE 1

| | Direct current | Alternating current | | Evaluation result | |
|---|---|---|---|---|---|
| | component DC (kV) | component AC Vpp (kV) | Current I (μA) | Density | Uneven density (Roughness) |
| Study Example 1 | 1 | No | 9 | Poor | Poor |
| Study Example 2 | 1.7 | No | 35 | Good | Poor |
| Study Example 3 | 2.5 | No | 90 | Poor | Poor |

As an evaluation standard, a solid image of two color mixture of magenta and cyan was printed in A4 size, and when an average value of the density measured at 9 points was less than 1.0, the evaluation was rated as "Poor", when it was 1 or more and less than 1.4, the evaluation was rated as "Not Bad", and when it was 1.4 or more, the evaluation was rated as "Good". Additionally, for the uneven density (roughness), the printed image was viewed with eyes, and as the evaluation standard, when the unevenness is conspicuous, the evaluation was rated as "Poor", when it was an extent of rather conspicuous and slightly annoying, the evaluation was rated as "Not Bad", and when it was an extent of almost inconspicuous and not annoying, the evaluation was rated as "Good".

Figure 5:
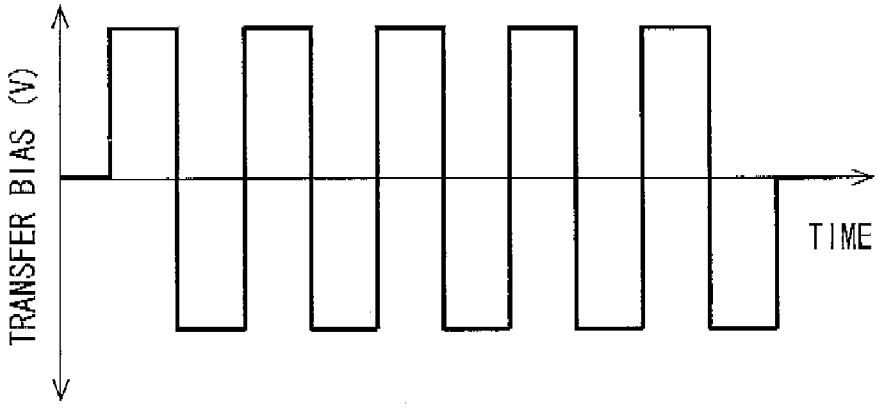
FIG. 5 PRIOR ART
FIG. 5 is a view showing a transfer bias voltage waveform in a conventional art.

Next, as Study Examples 4, 5 and 6, an alternating current component as shown in FIG. 5 was superimposed on a direct current component. The general and conventional alternating current component as shown in FIG. 5 is a rectangular wave whose rate (duty ratio) of the application time during which the transfer side potential is applied to the application time of a cycle during which the transfer side potential and the opposite transfer side potential are applied is 50%.

The direct current voltage DCV was 1 kV, and Vpps of the alternating current component were 0.56 kV, 2.5 kV, and 5 kV, respectively. A frequency of the alternating current component was 10 kHz for all. When exceeding 10 (kHz), since a minute toner adhesion called scattering is able to be seen around an image of a character or an image of a line, the frequency is preferable to be 10 (kHz) or less. The evaluation results are shown in Table 2.

TABLE 2

| | Direct current component DC (kV) | Alternating current component AC Vpp (kV) | Current I (μA) | Evaluation result Density | Evaluation result Uneven density (Roughness) |
|---|---|---|---|---|---|
| Study Example 4 | 1 | 0.56 | 9 | Poor | Poor |
| Study Example 5 | 1 | 2.5 | 11 | Not Bad | Poor |
| Study Example 6 | 1 | 5.0 | 14 | Not Bad | Not Bad |

Although a Vpp of the alternating current component was increased from 0.56 kV to 5 kV, the image density and the uneven density were improved, however, a good result (evaluated as "Good") was not obtained. Here, the reason why the direct current voltage was fixed to 1 kV was that the uneven density was not able to be improved even though the direct current voltage was increased according to the results shown in Table 1. Additionally, the reason why a Vpp of the alternating current component was increased only up to 5 kV was that the Vpp of 5 kV or more was impractical since in an actual product, a capacity increase of a high voltage transformer resulted in an increase in a cost.

Next, as Study Example 7, Vpp(1) was 1 kV, Vpp(2) was 560 V, the frequency f1 of the first period was 10 kHz, the frequency f2 of the second period was 10 kHz, the periodic number of the first period was two times, the periodic number of the second period was three times. The first periodic number shows the number of the period included in the first period, and the second periodic number shows the number of the period included in the second period.

Furthermore, as Study Examples 8 and 9, Vpp(1)s were increased to 2.5 kV and 5 kV, respectively. The evaluation results are shown in Table 3.

TABLE 3

| | Direct current component DC (kV) | Alternating current component AC Vpp (kV) | Current I (μA) | Evaluation result Density | Evaluation result Uneven density (Roughness) |
|---|---|---|---|---|---|
| Study Example 7 | 1 | Vpp(1) = 1.0, Vpp(2) = 0.56 | 10 | Poor | Poor |
| Study Example 8 | 1 | Vpp(1) = 2.5, Vpp(2) = 0.56 | 12 | Not Bad | Not Bad |
| Study Example 9 | 1 | Vpp(1) = 5.0, Vpp(2) = 0.56 | 14 | Good | Good |

In Study Example 9, the evaluations of the image density and the uneven density were "Good". From the above results, to enhance the image density and reduce the uneven density, it was found to be preferable that Vpp(1) was increased and a bias voltage in which a second period where a Vpp was small was provided following a first period where a Vpp was large.

From the evaluation results shown in Table 3, it is found that it is preferable to set Vpp(1)≦5 kV.

Moreover, as Study Examples 10, 11 and 12, Vpp(1) was fixed to 5 kV, and Vpp(2)s were increased to 280 V, 1.1 kV and 2.5 kV, respectively.

The evaluation results are shown in Table 4.

TABLE 4

| | Direct current component DC (kV) | Alternating current component AC Vpp (kV) | Current I (μA) | Evaluation result Density | Evaluation result Uneven density (Roughness) |
|---|---|---|---|---|---|
| Study Example 10 | 1 | Vpp(1) = 5.0, Vpp(2) = 0.28 | 12 | Good | Not Bad |
| Study Example 11 | 1 | Vpp(1) = 5.0, Vpp(2) = 1.1 | 15 | Good | Good |
| Study Example 12 | 1 | Vpp(1) = 5.0, Vpp(2) = 2.5 | 17 | Not Bad | Not Bad |
| Study Example 13 | 1 | Vpp(1) = 5.0, Vpp(2) = 0.56 | 14 | Good | Not Bad |

When Vpp(2) was too smaller than Vpp(1), the uneven density was increased, and when Vpp(2) became closer to Vpp(1), an opposite transfer occurred and lowering of image density occurred. Furthermore, as Study Example 13, when the final potential of Study Example 9 was made to be the opposite transfer side potential, the uneven density was increased.

From the evaluation results shown in Table 4, it was found that Vpp(1)/Vpp(2), which is a ratio of Vpp(1) and Vpp(2), was preferable to be 2<Vpp(1)/Vpp(2)<17.8.

Additionally, from the evaluation results shown in Table 3 and Table 4, it was found that Vpp(2) was preferable to be 0.56 kV≦Vpp(2)≦1.1 kV.

Figure 3B:
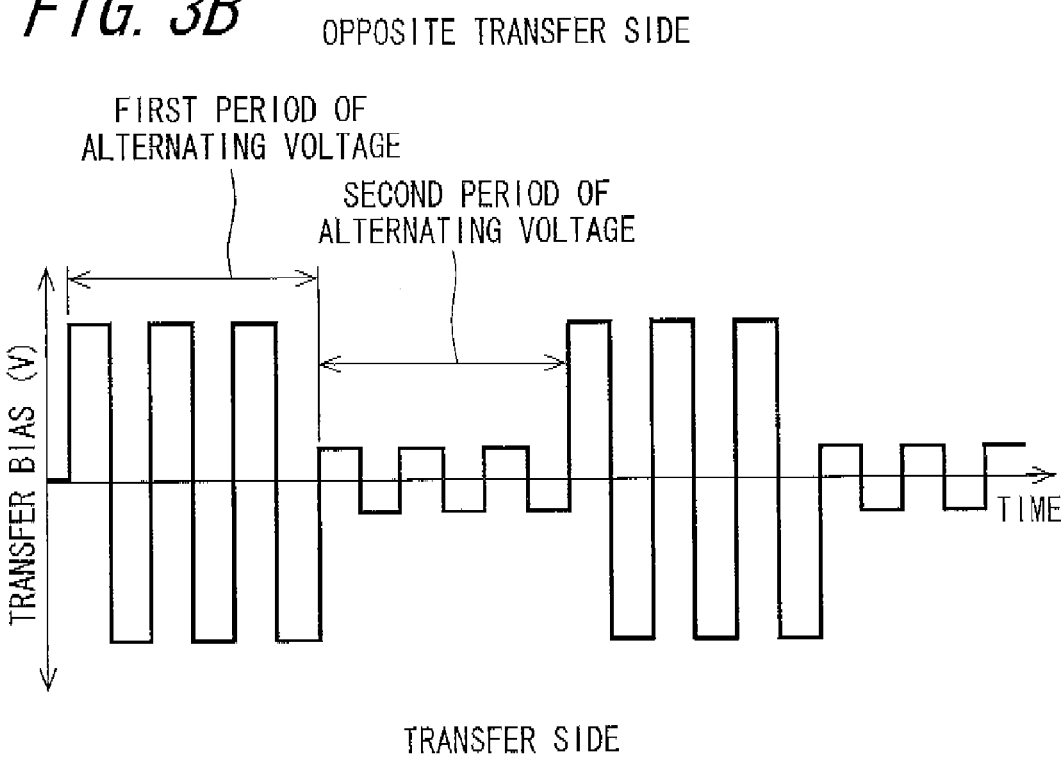
FIG. 3B is a view showing another transfer bias voltage waveform of the invention.
Figure 3C:
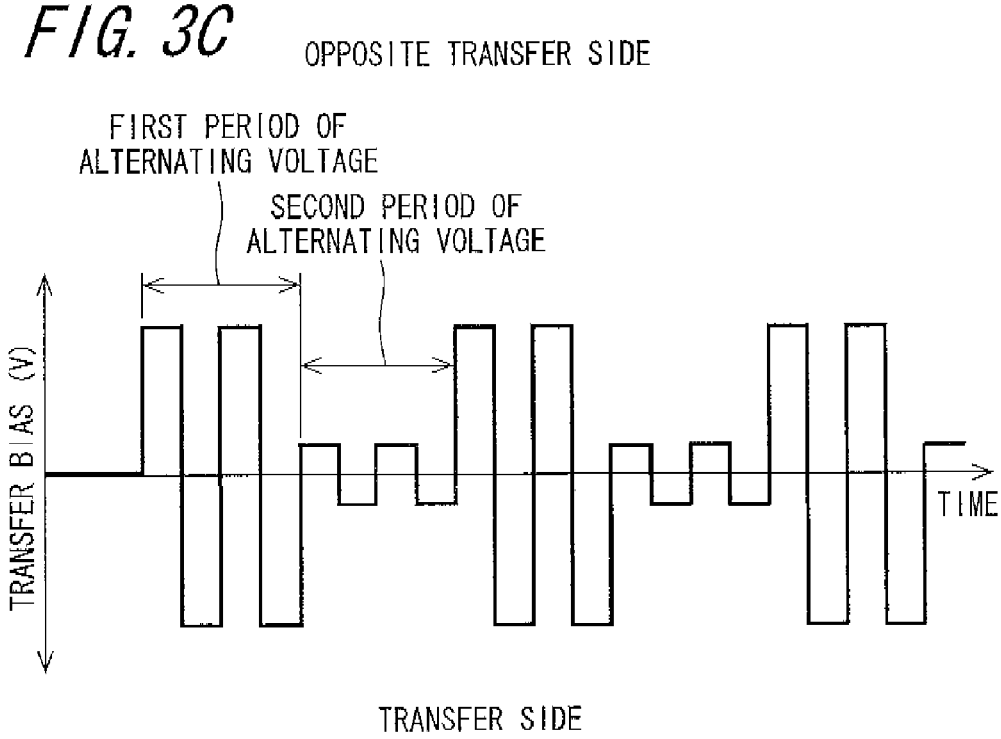
FIG. 3C is a view showing still another transfer bias voltage waveform of the technology described herein.

The first periodic number and the second periodic number are preferable to be two times or three times, as shown in FIGS. 3A, 3B and 3C. When the periodic number is one time, the image density is lowered since the capability to move the toner from the intermediate transfer belt 63 to the sheet P runs short. Moreover, in the case of four times or more, the capability to move the toner from the intermediate transfer belt 63 to the sheet P is too intense conversely, thereby the uneven density is increased. From this, the first periodic number and the second periodic number are preferable to be two times or three times.

Figure 6:
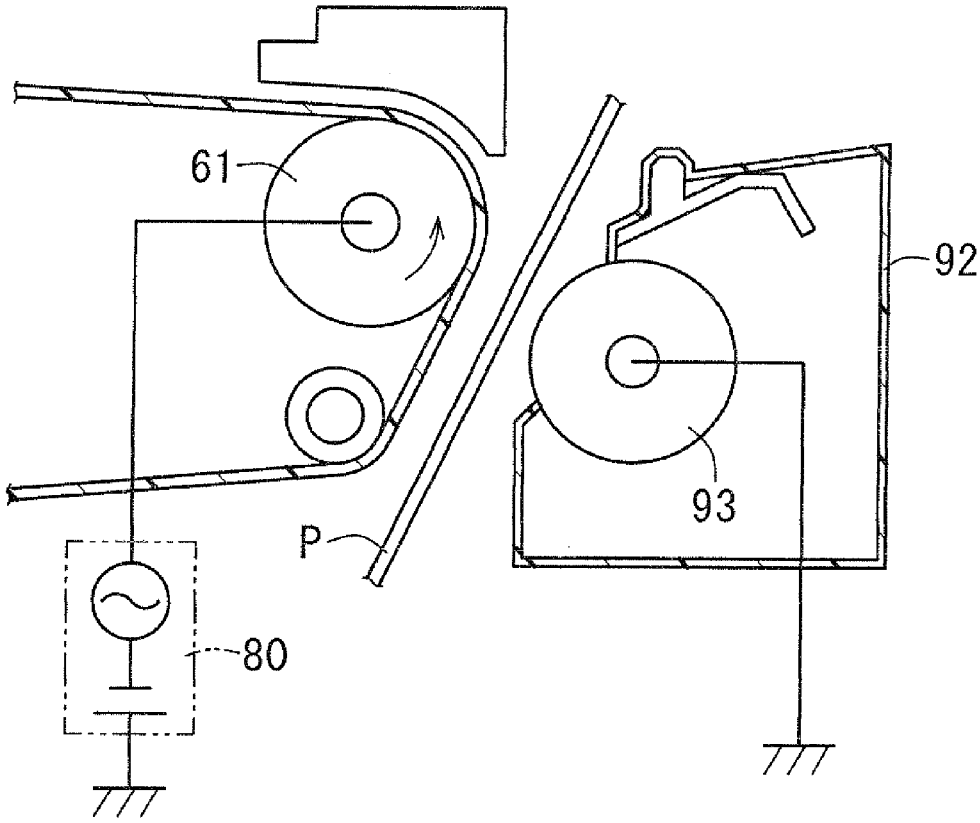
FIG. 6 is an enlarged view of a secondary transfer member section in a second embodiment.

Next, description will be given for a second embodiment of the technology described herein. In the first embodiment, the secondary transfer member section 70 includes the secondary transfer belt 73, and the transfer bias is applied to the sheet P from the secondary transfer roller 71 through the secondary transfer belt 73. In the second embodiment, a transfer roller is used in place of the transfer belt. FIG. 6 is an enlarged view of a secondary transfer member section 92 of the embodiment. The secondary transfer member section 92 includes a secondary transfer roller 93. The secondary transfer roller 93 has the same configuration as the secondary transfer roller 71 of the secondary transfer member section 70.

Furthermore, the transfer bias may be applied to the driving roller 61 in place of the secondary transfer roller 93.

Note that, in the above first and second embodiments, although a case where a two-component developer is used is described, the technology described herein has a characteristic in the transfer bias that transfers the toner to the sheet P and not limited to the two-component developer, and even in a case where a one-component developer is used, same effects are able to be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A transfer device comprising:

a toner image bearing member that bears a toner image thereon;

a transfer section that transfers the toner image borne on the toner image bearing member onto a recording medium; and a bias applying section that applies a transfer bias voltage for transferring the toner image, the bias applying section applying a transfer bias voltage which an alternating voltage is superimposed on a direct current voltage, the alternating voltage having an alternating voltage waveform in which a transfer side potential to shift the toner image from the toner image bearing member to the recording medium and an opposite transfer side potential to shift the toner image from the recording medium to the toner image bearing member are applied so as to alternate with each other, and a first period in which a first peak-to-peak voltage is applied and a second period in which a second peak-to-peak voltage, lower than the first peak-to-peak voltage, is applied, are alternately repeated, and when f1 denotes a frequency of the first period and f2 denotes a frequency of the second period, f1=f2 is satisfied.

2. The transfer device of claim 1, wherein a potential applied at an end of the first period is the transfer side potential in the alternating voltage.

3. The transfer device of claim 1, wherein a periodic number of waves included in the first period of the alternating voltage is two or three.

4. The transfer device of claim 1, wherein a periodic number of waves included in the second period of the alternating voltage is two or three.

5. The transfer device of claim 1, wherein the following expression is satisfied in the alternating voltage:

$$2 \leqq Vpp(1)/Vpp(2) \leqq 17.8,$$

where Vpp(1) denotes a peak-to-peak voltage in the first period and Vpp(2) denotes a peak-to-peak voltage in the second period.

6. The transfer device of claim 1, wherein the frequency f1 in the first period is 10 kHz or less in the alternating voltage.

7. The transfer device of claim 1, wherein the peak-to-peak voltage in the first period Vpp(1) satisfies the following expression in the alternating voltage:

$$Vpp(1) \leqq 5 \text{ kV}.$$

8. The transfer device of claim 1, wherein the bias applying section applies the transfer bias voltage to the transfer section.

9. The transfer device of claim 1, wherein the bias applying section applies the transfer bias voltage to the toner image bearing member.

10. An image forming apparatus comprising:

an electrostatic latent image bearing member that bears an electrostatic latent image thereon;

a developing device that develops the electrostatic latent image to form a toner image for transferring to a toner image bearing member; and the transfer device of claim 1.

* * * * *